United States Patent [19]

Musgrave

[11] 4,109,401

[45] Aug. 29, 1978

[54] MAGAZINE CONTENTS INDICATORS

[76] Inventor: Daniel Dennis Musgrave, 8201 Caraway St., Cabin John, Md. 20731

[21] Appl. No.: 826,895

[22] Filed: Aug. 22, 1977

[51] Int. Cl.[2] ..... F41C 25/02

[52] U.S. Cl. ..... 42/50; 42/1 A

[58] Field of Search ..... 42/50, 6, 7, 1 A

[56] References Cited

U.S. PATENT DOCUMENTS

| | | | |
|---|---|---|---|
| 2,828,568 | 4/1958 | Sakewitz | 42/50 |
| 3,087,270 | 4/1963 | Stoner | 42/50 |
| 3,273,275 | 9/1966 | Badali | 42/50 |
| 3,345,771 | 10/1967 | Silsby | 42/50 |
| 3,999,321 | 12/1976 | Musgrave | 42/7 |

FOREIGN PATENT DOCUMENTS

| | | | |
|---|---|---|---|
| 875,222 | 8/1961 | United Kingdom | 42/50 |

OTHER PUBLICATIONS

"The Steyr-Mannlicher Rifles," by Clair Rees; *Guns*; Jun. 1974; p. 70.

*Primary Examiner*—Charles T. Jordan

[57] ABSTRACT

Devices to indicate the presence of cartridges in firearms magazines, or to indicate that the magazine is empty. A magazine is shown with a translucent casing for storing cartridges. Means are disclosed to count cartridges within such a casing. A cartridge follower is disclosed having brilliant coloration thereon to indicate by its location in the casing whether or not the magazine is empty.

3 Claims, 5 Drawing Figures

MAGAZINE CONTENTS INDICATORS

MAGAZINE CONTENTS INDICATORS

It is a common practice with modern firearms to use detachable cartridge magazines, which can be removed from the firearm when empty and replaced with a full magazine. The user therefore carries several magazines; for example, at present in some armies the riflemen are provided with seven magazines.

The large number of magazines carried constitute a possible source of confusion. Under adverse conditions, such as poor light, it is sometimes difficult to distinguish empty magazines from those not completely empty. Furthermore it would be an advantage if an easy method could be provided to determine how many cartridges remain in a partly expended magazine. For safety reasons it would also be desirable to have means on the magazine to indicate when the magazine contains no cartridges.

It is an object of this invention to provide devices for cartridges magazines to indicate if said magazines contain cartridges, or are empty.

Another object is to provide means to facilitate counting any cartridges present in such a magazine.

These and other objects of the present invention will become apparent upon reference to the following specification, taken in connection with the accompanying drawings, wherein.

Figures 1, 2, 3, 4, 5:
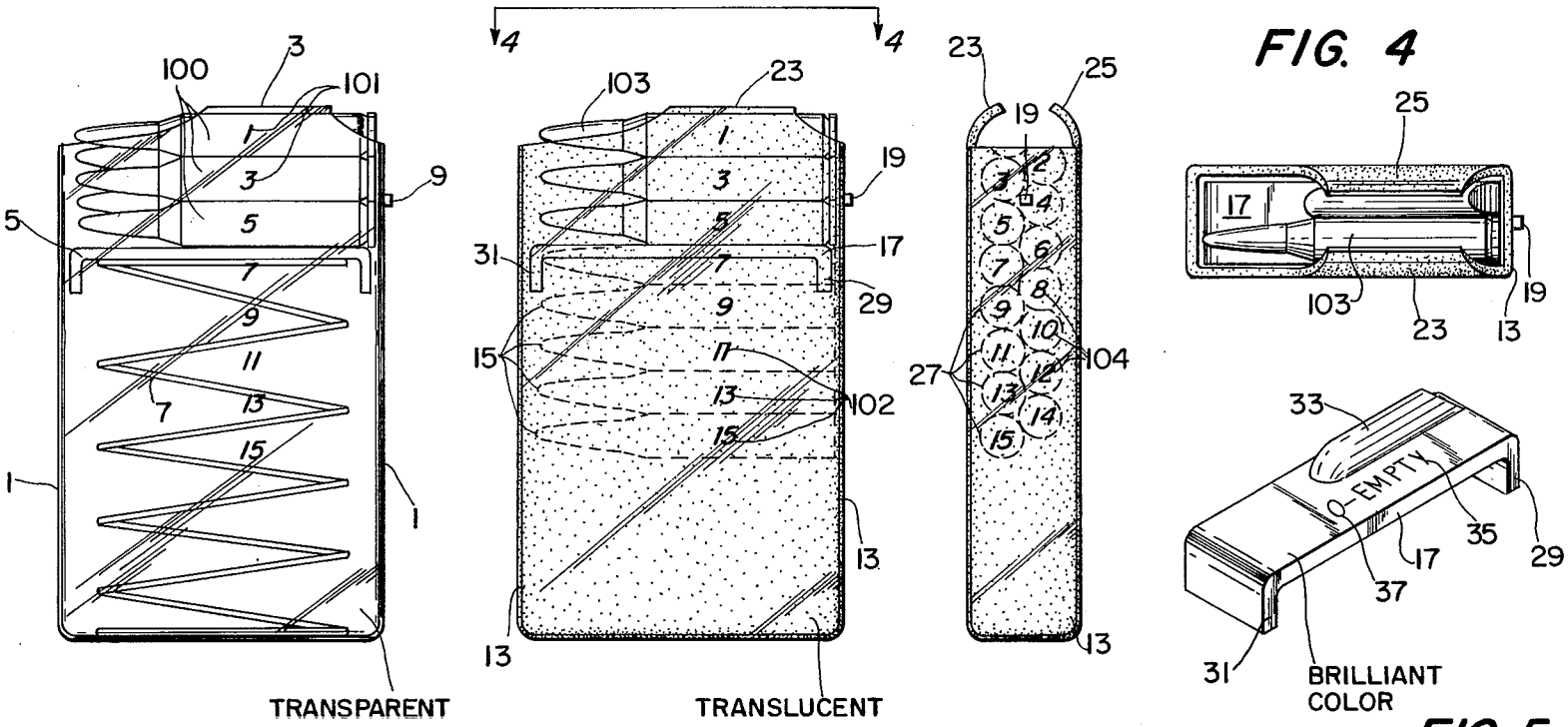
FIG. 1 is a side view of a transparent magazine with cartridges therein.
FIG. 2 is a side view of a translucent magazine with cartridges therein.
FIG. 3 is a rear view of the empty casing of the magazine shown in FIG. 2.
FIG. 4 is a top view of the magazine shown in FIG. 2 as indicated by line 4—4 thereon.
FIG. 5 is a view of a cartridge follower, as shown in the magazine disclosed in FIGS. 2 and 3, and also useable in various other types of magazines.

The drawings have been prepared for purposes of disclosure and they do not show any particular magazine. This invention can be applied to magazines for various classes of firearms. It is not intended to restrict the utility of the invention to any particular magazine, or any particular firearm. It can be used with both existing, and future firearms. It can also be used with various types of ammunition. The cartridge follower disclosed hereinafter can also be retro-fitted into existing magazines.

Referring to drawings, FIG. 1 shows a magazine having a casing 1 adapted for storing cartridges in the well-known manner. The casing is made of clear plastic, or some other transparent material. At the top of the magazine is a typical feed lip 3, which is retaining a cartridge in a feeding position. Within the casing is disposed a cartridge follower 5, which is engaged by a lifting spring 7 in the well-known manner.

Clearly seen through the casing is a group of cartridges 100 which are urged toward the feeding position by follower 5. Marked on the casing are numbers 101, which are positioned so as to permit counting cartridges within the casing. A lug 9 is fixed on the rear of the casing to engage with means in a firearm (not shown) and hold the magazine therein.

A magazine such as that shown in FIG. 1 would permit easy counting of cartridges therein but it would not be practical for hunting or military use, because it would reflect the sun. However, it might have other uses, as for observation of functioning during magazine development.

FIG. 2 shows a magazine having a translucent casing 13 having graduations 15, substantially in the profile of a cartridge, marked thereon. The graduations are positioned on each side of the casing at locations adjacent to the positions of cartridges when within the casing. Numbers 102 are applied to the graduations to assist in counting cartridges within the casing.

Positioned in casing 13 is a magazine follower 17 which engages with a lifting spring (not visible in FIG. 2) and urges any cartridges in the casing toward retaining lip 23 in the usual manner. The follower will be described in detail below in connection with FIG. 5.

A portion of a cartridge 103 is visible in FIG. 2. It is retained at a feeding position by lip 23 in the usual manner. The casing also has a lug 19 adapted to engage with means (not shown) in a firearm to retain the magazine therein.

FIG. 3 is a rear view of the casing 13 of the magazine in FIG. 2, but without cartridges, follower, or spring therein. The casing has the usual feed lips 23 and 25 and lug 19 is also seen in this view.

Formed on the rear of the casing are circular graduations 27, positioned substantially adjacent to the usual locations of any cartridges stored in the casing. Numbers 104 can be marked on the casing near the graduations to assist in counting any cartridges in the casing.

FIG. 4 is a top view of the magazine shown in FIG. 2, as indicated by line 4—4 on said view. However only a single cartridge 103 is in the magazine in this view, and therefore a portion of follower 17 is visible through the open top of the magazine.

FIG. 5 shows follower 17 in detail. The follower has the usual rib 33 on the cartridge platform and has legs 29 and 31 extending downward from the platform to guide the follower in the casing in the usual manner. The exact geometry of the follower is not critical to this invention. The shape shown in FIG. 5 is merely exemplary.

Follower 17 is made with a brilliant exterior color. Such a brilliant color could be some color which is unusual in the gun and ammunition art. The said color might also be applied in luminescent form. Obviously the coloring material may be part of the follower itself, meaning that the material used in making the follower includes coloring matter.

Furthermore a word 35 or a symbol 37 may be placed on the follower. The word or symbol is so positioned that a single cartridge in the magazine will cover said word or symbol as disclosed in FIG. 4. In FIG. 4 it will be noted that cartridge 103 is resting on follower 17, and hiding the word "EMPTY" and the symbol "0."

In operation, when a magazine such as that in FIG. 2 contains cartridges, they will be visually perceptible through the casing. Because of its brilliant color, the follower will be more perceptible than the cartridges.

As the user looks at the casing, he will be aided in determining how many cartridges are contained therein by the location of the follower, by some perception of the cartridges through the casing, by the graduations, and by the numbers on the casing. Depending upon the construction of the magazine it will be necessary to look at the side on which the lowest cartridge therein is located.

In the same manner he can look at the rear of the magazine, and observe the shadows of the cartridges, location of the follower, and the graduations and numbers on the casing.

To be certain that a magazine contains no cartridges he can look into the open feed end and easily see any cartridges against the background of the brilliantly colored follower. If the follower has a word or symbol thereon as in FIG. 5, it will be visible if the magazine is empty. Furthermore the follower of an empty magazine should be positioned close to the feed lips.

It is desired to point out that such use of visible means on a follower can be applied to magazines having opaque casings. It is also desired to point out that under conditions of poor light where actual counting of cartridges in a translucent casing is not possible, the location of the follower will provide an approximate estimation of how many cartridges are in a magazine. It might be objectionable to make the entire follower luminescent because it could possibly give away the shooters position during night operations. To meet this objection only a limited portion of the follower might be made luminescent.

The numbers on the casing and the word and symbol on the follower can be marked on the items or can be formed out of the material of which said items are made.

What I claim is:

1. A cartridge magazine follower having visible means thereon positionally adapted to facilitate visual determination of whether said follower is so positioned in a magazine that said magazine must necessarily be empty of cartridges, said visible means including a luminescent coloration.

2. A follower as set forth in claim 1 wherein said visible means includes brilliant coloration on said follower.

3. A follower as set forth in claim 2 wherein said coloration is in contrast to the typical coloration of cartridges used in said magazine.

* * * * *